United States Patent [19]

Clark

[11] Patent Number: 4,697,160

[45] Date of Patent: Sep. 29, 1987

[54] HYBRID POWER COMBINER AND AMPLITUDE CONTROLLER

[75] Inventor: Robert T. Clark, Buena Park, Calif.

[73] Assignee: Hughes Aircraft Company, Los Angeles, Calif.

[21] Appl. No.: 811,870

[22] Filed: Dec. 19, 1985

[51] Int. Cl.[4] ..... H01P 5/16; H01P 5/18

[52] U.S. Cl. ..... 333/103; 333/104; 333/109; 333/116; 333/117

[58] Field of Search ..... 333/101, 103, 104, 109, 333/111, 113, 114, 116, 117, 120

[56] References Cited

U.S. PATENT DOCUMENTS

| | | | |
|---|---|---|---|
| 3,017,585 | 1/1962 | Luke | 333/113 X |
| 3,475,700 | 10/1969 | Ertel | 333/104 |
| 3,659,227 | 4/1972 | Whistler | 333/109 X |
| 3,678,414 | 7/1972 | Hallford | 333/104 |
| 4,119,931 | 10/1978 | Hudspeth et al. | 333/111 X |
| 4,216,445 | 8/1980 | Abajian | 333/81 R |
| 4,373,207 | 2/1983 | Hecken | 455/139 |
| 4,387,353 | 6/1983 | Giallorenzi et al. | 333/111 |

*Primary Examiner*—Paul Gensler

*Attorney, Agent, or Firm*—Thomas A. Runk; Anthony W. Karambelas

[57] ABSTRACT

A hybrid power combiner and controller device is disclosed. The device includes a multiple branch hybrid network, with PIN diodes employed to selectively short circuit the midpoints of the branch lines to ground. With the PIN diodes biased to the open circuit condition, the device behaves as a conventional hybrid combiner, for example, to combine the power produced by two input sources at the device output port. With the PIN diodes biased to the conductive condition, thereby shorting the branch line midpoints to ground, the device behaves as a matched multiple stub filter tuned to the desired band. Substantially all the power provided by one input power source will be provided at the device output in this case.

3 Claims, 4 Drawing Figures

HYBRID POWER COMBINER AND AMPLITUDE CONTROLLER

BACKGROUND OF THE INVENTION

The present invention relates to hybrid networks, and more particularly to an improved network for selectively combining microwave power presented at two input ports of the network at an output port with minimum insertion loss.

Four port hybrid networks for combining at one output port the power generated by two RF sources and presented at two ports of the network are well known in the art. An exemplary reference is the paper "A Method of Analysis of Symmetrical Four-Port Networks," by J. Reed and G. J. Wheeler, IRE Trans. MTT, October 1956, pp. 246–252. In general, these networks are symmetrical and may be implemented in strip-line, coaxial lines, waveguide, or other transmission lines. In a typical configuration, the network may be configured as a 3 decibel (dB) multiple branch hybrid network, wherein the RF power presented at the two input ports is combined at an output port, the fourth port of the network comprising the isolated port. This network configuration may also be viewed in the reciprocal sense as a power divider wherein the RF power presented at one input port is divided between two output ports, the fourth port of the network comprising the isolated port.

One typical application of a hybrid power combiner is in solid state transmit/receive modules for radar systems, in which the outputs of two high power RF transistors are combined by a hybrid network. For a two transistor combiner circuit, if one transistor is turned off, the output power at the output port of the combiner drops, not by 3 dB, but by 6 dB because now the network operates as a power divider circuit wherein the RF power from the remaining operational transistor will be divided between the isolation port and the output port. Thus, the output power of the combiner circuit will be reduced to 25% of the power provided by two operational transistors, even though one of the two power transistors is still operational.

Another typical application of a four-port hybrid power combiner is in solid state transmitters for radar systems, where aperture amplitude distribution control is required. In this application, the outputs of numerous high power RF transistors are combined, utilizing a network comprising a number of four port hybrid networks. For a network combining N transistors, the decrease in power resulting from turning off M of the N transistors is given by Equation 1.

$$\text{Power Decrease (dB)} = 10 \log ((N-M)/N)^2 \quad (1)$$

Thus, for the case of two transistors one of which is turned off, the decrease in power is 6 dB, as described above.

For a network comprising only a small number of transistors, the amplitude control achieved by the conventional combining network is not very fine. For a network comprising a larger number of transistors, the amplitude control achieved by the conventional network is finer, but may still not be sufficient for the particular application. However, in all cases, RF power is wasted by dissipation in the RF loads at the isolated ports of the four port hybrid networks, in general requiring additional cooling.

Conventional combining networks operate in this manner because they have been designed to combine the outputs of a fixed number N of transistors with voltage coupling factors equal to $1/(N)^{\frac{1}{2}}$ because each respective input port and the output port. When such a network is operated as a combiner of N-M transistors, the conventional combiner network cannot combine the reduced power without some loss.

One known amplitude controller comprises two cascaded 3 dB hybrid networks, with a PIN diode phase shifter coupling the two output ports of the first hybrid network (when viewed as a divider) to the input ports of the second hybrid. This device suffers from a relatively higher insertion loss and requires additional elements in addition to the two hybrid coupler networks.

Another known circuit employs a matched reactive Tee with PIN diodes. Transformers are employed for matching when both input ports are activated. When the PIN diodes are biased to a short circuit, one arm behaves as a shorted quarter wavelength stub and the other arm transforms the still active port to the incorrect impedance level for a match. Thus, this known device suffers from mismatch loss when one port is turned off.

It would therefore represent an advance in the art to provide an RF power combiner which not only achieves power combination but also finer amplitude control with less insertion loss than conventional combiner circuits.

It would also be advantageous to provide an RF power combiner which not only achieves power combination but also finer amplitude control, which employs relatively few elements and is of relatively small size.

It would also represent an advance in the art to provide an RF power combiner which not only achieves power combination but also finer amplitude control without dissipating, except for $I^2R$ losses, the RF power the combiner was intended to combine.

SUMMARY OF THE INVENTION

A hybrid power combiner and controller device is disclosed. The invention adapts the N transistor (or other power source) combiner network to an N-M transistor combiner by changing the voltage coupling from the nonoperational transistor input ports to zero. In the disclosed embodiment of the invention, this adaptation is implemented by modifying the coupling values of the individual four port hybrid networks to zero and one, respectively. The device includes a multi-branch hybrid network, comprising two main lines coupled together by a plurality of branch lines, each an odd number of quarter-wavelengths in length, separated by a spacing equivalent to an odd number of quarter-wavelengths. The device further comprises means for selectively shorting the midpoints of the branch lines to ground. The shorting means may comprise, for example, PIN diodes coupled between the respective midpoints and ground, and bias circuits for selectively biasing the PIN diodes in the open circuited and conductive states. With the shorting means in the open circuit state, the device operates as a conventional power combiner device to combine at the output port the power provided at the input ports. The voltage coupling of each input port to the single output is equal to $(2)^{\frac{1}{2}}/2$ for this open circuit state. With the shorting means in the conductive state, however, the main lines of the hybrid combiner circuit are isolated and the device operates as a pair of matched multiple stub filters. The voltage coupling factor of one of the input ports to the output port is one, and the voltage coupling factor of the other input port to the output port is zero for this conductive state.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
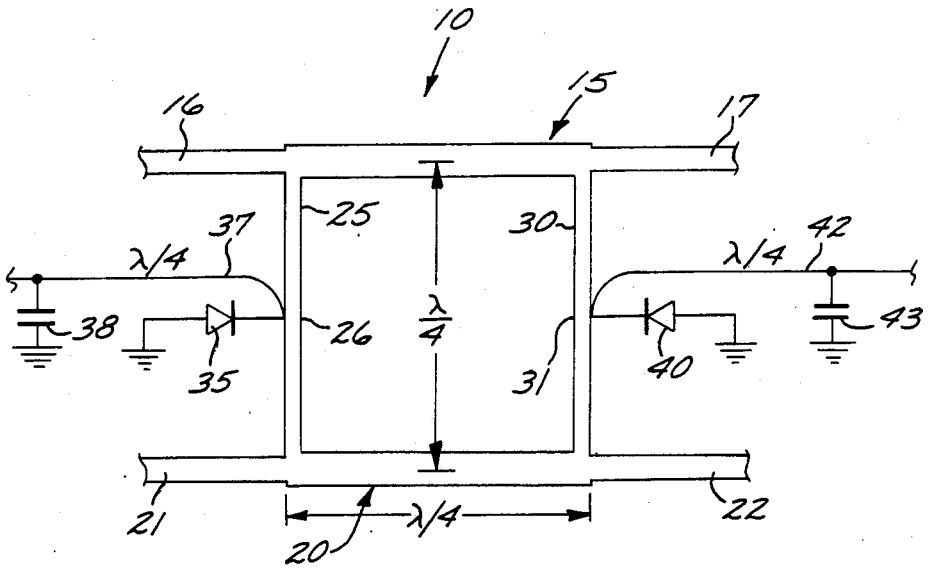
FIG. 1 is a schematic representation of a hybrid power combiner and amplitude controller circuit which employs the invention.

A schematic representation of a hybrid power combiner and amplitude controller 10 employing the invention is set forth in FIG. 1. The circuit comprises a conventional 3 dB, two branch, hybrid combiner circuit. Thus, main transmission lines 15 and 20 are coupled together by branch transmission lines 25 and 30. As is conventional, the main lines 15 and 20 are connected by branch lines 25 and 30, each about one-quarter wavelength in length at the center frequency of interest. The branch lines 25 and 30 intersect the main lines 15 and 20. The intersections along the main lines 15 and 20 are separated by a distance of about one-quarter wavelength at the center frequency of interest.

In accordance with the invention, means are provided for selectively shorting the respective midpoints 26 and 31 of the branch lines 25 and 30 to ground. In the disclosed embodiment, the shorting means comprises PIN diodes 35 and 40. An exemplary PIN diode which is available commercially is the Hewlett-Packard part number 5082-3040 PIN diode. The respective cathodes of the PIN diodes 35 and 40 are connected to the midpoints 26 and 31 of the branch lines 25 and 30. The anodes of the PIN diodes are each connected to ground. The shorting means further comprises a pair of bias lines 37 and 42 connected to the midpoints 26 and 31, with respective RF shorting capacitors 38 and 43 arranged at one-quarter wavelength spacings along the respective bias line 37 and 42 for shorting the RF energy to ground. By application of an appropriate negative DC bias voltage to the respective bias lines 37 and 42, the PIN diodes 35 and 40 are biased to the conductive state to provide a short circuit to ground. Moreover, the shorting capacitors located at one-quarter wavelength spacing from the midpoints 26 and 31 appear as open circuits at the midpoints, so that the dc bias lines 37 and 42 do not affect the RF performance of the device 10.

The use of PIN diodes in RF phase shifter devices, as well as the circuits to properly bias the diodes, is well known to those skilled in the art.

When the PIN diodes are biased in the open circuit state, the circuit 10 behaves as a conventional 3 dB hybrid as used, for example, in power combining of two high power RF transistors (not shown) in a typical transmit/receive radar module. Thus, the transistor outputs may be respectively coupled to input ports 16 and 21 of the device 10 with the combined power at point 22. Port 17 of device 10 is the isolated port. The voltage coupling factor between each input port 16 and 21 to the output port 22 for this case is $(2)^{\frac{1}{2}}/2$ or 0.707.

By biasing the PIN diodes 35 and 40 to the short circuit state, the device 10 behaves as two matched multiple stub filters tuned to the desired band. The main lines 15 and 20 are isolated from one another so that the input signals provided at the respective input ports 16 and 21 are respectively transmitted to the isolated port 17 and the output port 22. In this short circuit state, the voltage coupling factor between input port 16 and output 22 is zero, and the voltage coupling factor between input port 21 and output port 22 is one. To avoid dissipating power into the RF load (not shown) typically connected at the isolation port, the RF power source coupled to input port 16 should be turned off.

Figure 2:
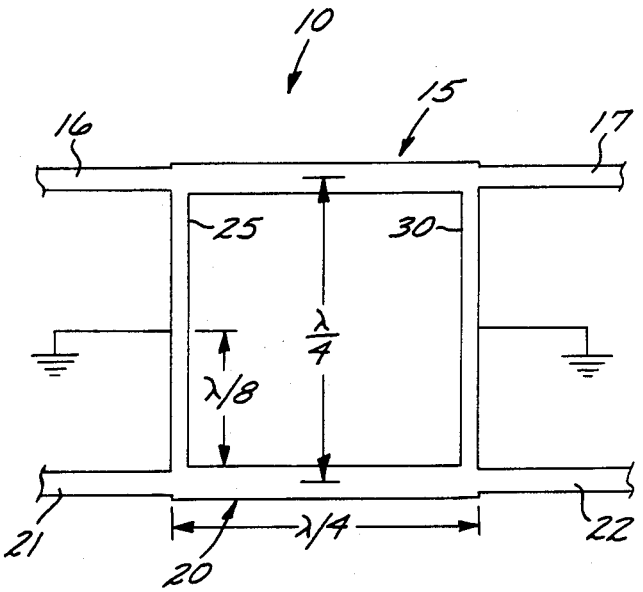
FIG. 2 is an equivalent circuit representation of the circuit of FIG. 1 when the PIN diodes are in the short circuit state.

The filter equivalent circuit corresponding to the short-circuited state is depicted in FIG. 2. The branch lines now act as shorted stubs having a length of one-eighth wavelength. The filter is matched because the short circuits at the midpoints of the branches simulate an odd mode excitation of the hybrid, which by design and analysis is matched. See "A Method of Analysis of Symmetrical Four-Port Networks," J. Reed and G. J. Wheeler, IRE Trans. MTT, October, 1956, pp. 246–252.

With the PIN diodes shorted, a 3 dB decrease in the power output of the device 10 at the output port 22 is obtained. In this case, the output power results from the input power provided at input port 21; input port 16 is isolated from main line 20 in this configuration. Without the PIN diodes, a 6 dB power drop is suffered when an RF transistor is turned off.

The device 10 may be constructed using virtually any type of constrained transmission lines. Devices fabricated in stripline or microstrip are particularly well suited to implementation of the invention.

Figure 3:
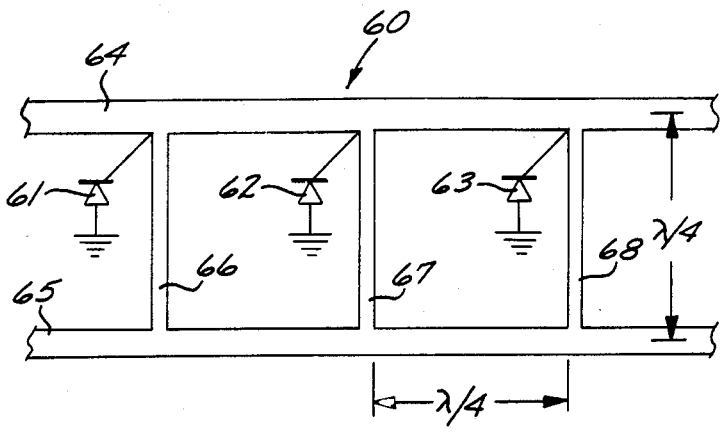
FIG. 3 is a schematic representation of a three branch hybrid device employing the invention.

Sufficient degrees of freedom exist in the case of a three branch hybrid to allow the impedance of the main line 15 and 20 to be designed to be equal to the impedance of the connecting lines at ports 16, 17, 21 and 22, and therefore the shorting diodes can alternatively be placed at the junction of the main and branch lines. Thus, the various device parameters such as the main and branch line impedances provide sufficient degrees of freedom enabling the device to be designed for match, isolation and power balance. An exemplary three branch device 60 is shown in FIG. 3, with the shorting diodes 61, 62 and 63 disposed at the junction of the main line 64 and the respective branch lines. For clarity, the diode bias lines are omitted in FIG. 3.

Figure 4:
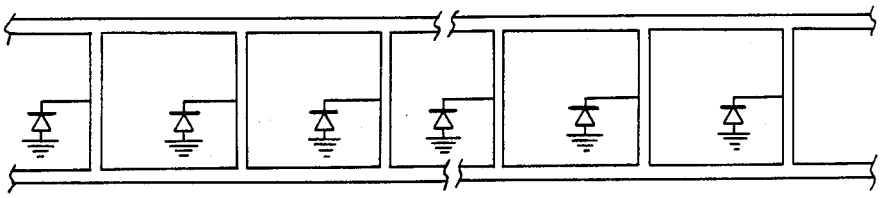
FIG. 4 is a schematic representation of a multiple branch hybrid device employing the invention.

The invention may be employed with multiple branch hybrid couplers to obtain levels of amplitude control other than 3 dB. FIG. 4 illustrates an N-branch hybrid coupler with N PIN diodes provided as shorting elements. The degree of voltage coupling may be varied by shorting or open-circuiting particular ones of the PIN diodes in the manner described above with respect to the device of FIG. 1.

A hybrid power combiner and amplitude controller device has been disclosed. The device provides power combining and finer amplitude control with less insertion loss, and is of smaller size with fewer components than known prior art devices, and does not dissipate any of the input power except for $I^2R$ losses.

It is to be understood that the invention is not limited to use with the particular 3 dB hybrid network illustrated in FIG. 1. Various other hybrid networks are known in the art, such as the "rat race" network, for example. It is believed that the invention may be advantageously implemented with various types of hybrid networks. Moreover, it is contemplated that the invention may be employed in power combiner circuits for combining the output power of N power sources, wherein a number of four port hybrid devices employing the invention are cascaded together in a network to combine and control the output powers of the respective power sources at a single output port. The specific manner in which the hybrid devices are interconnected. is conventional, as described hereinabove in the background. By controlling the PIN diodes of specific ones of the four port networks, finer amplitude control of the power combination of the circuit can be achieved. By also controlling the operation of the power sources whose outputs are not being combined at the output, unnecessary RF power dissipation is avoided.

It is understood that the above-described embodiment is merely illustrative of the possible specific embodiments which may represent principles of the present invention. Other arrangements may be devised in accordance with these principles by those skilled in the art without departing from the spirit and scope of the invention.

What is claimed is:

1. A hybrid network power combiner and controller device operable at microwave frequencies, comprising:

a multi-branch hybrid power combiner circuit, comprising two main transmission lines coupled by at least three branch transmission lines which are an odd number of quarter-wave lengths of a frequency of interest in length; and means for selectively shorting to ground each junction between one of said main transmission lines and each of said branch transmission lines.

2. The network of claim 1 wherein the impedance of each main line is equal to the impedance of each branch line.

3. A hybrid network power combiner and controller device operable at microwave frequencies, comprising:

a multi-branch hybrid power combiner circuit, comprising two main transmission lines coupled by at least three branch transmission lines which are an odd number of quarter-wavelengths of a frequency of interest in length; and means for selectively shorting to ground the junctions of one main line with the respective branch lines, said shorting means comprising a plurality of PIN diodes coupling respective ones of the branch transmission lines to ground, and biasing means for biasing the respective diodes to the conductive condition, wherein said PIN diodes are coupled cathode-to-anode between a respective junction and ground and wherein said biasing means comprises respective quarter-wavelength bias lines coupled to the respective cathodes of said PIN diodes and respective shorting capacitors having respective first terminals connected to said bias lines at quarter-wavelength distances from said cathodes and having respective second, grounded terminals;

whereby said device operates as a hybrid power combiner in a first state when said shorting means is open-circuited, and as a pair of isolated main lines when said branch lines are shorted.

* * * * *